United States Patent [19]

Solica

[11] 4,044,637

[45] Aug. 30, 1977

[54] TOOL FOR CLOSING BOTTLES BY A CROWN CAP

[76] Inventor: Georges Solica, 6, chemin de Renens, Lausanne, Switzerland, CH-1000

[21] Appl. No.: 612,032

[22] Filed: Sept. 10, 1975

[30] Foreign Application Priority Data

Sept. 26, 1974 Switzerland ..... 13012/74

[51] Int. Cl.[2] ..... B67B 5/00; B67B 7/16

[52] U.S. Cl. ..... 81/3.43; 81/3.46 R

[58] Field of Search ..... 81/3.34, 3.4, 3.46 R, 81/3.44, 3.1 R, 3.43, 64; 215/238, 277

[56] References Cited

U.S. PATENT DOCUMENTS 1,712,987 5/1929 Forster ..... 81/3.44 UX 1,797,106 3/1931 Sweeney ..... 81/3.44

FOREIGN PATENT DOCUMENTS 574,388 3/1958 Italy ..... 81/3.1 R

*Primary Examiner*—Al Lawrence Smith
*Assistant Examiner*—Roscoe V. Parker
*Attorney, Agent, or Firm*—Emory L. Groff, Jr.

[57] ABSTRACT

The tool comprises a handle pivotally connected to a head that comprises a tightener composed of a split ring having a diameter sufficiently large to encompass the cap. The handle has a cam arrangement that acts on the ring to contract it when the handle is pivoted, thereby tightening the cap on the bottle. The head also has one or more lips that catch underneath the cap to remove the latter when opening the bottle.

16 Claims, 6 Drawing Figures

TOOL FOR CLOSING BOTTLES BY A CROWN CAP

Beverage bottling plants have come more and more to replace corks and screw caps, or lids, with crown caps, which cover the bottle neck and the lower skirt of which is crimped underneath a slight collar, or bead, at the end of the neck.

As in known, the cap is crimped in the production line machines by a crimper that tightens the cap on the neck. In domestic use, it is rather difficult to close a bottle that has been capped with a crown cap; as a rule, a stopper or cap of some kind, different from the crown cap, must be found to close the opened bottle.

It is true that there is described in Swiss Pat. No. 476,628 a tool for replacing the crown cap on the bottle after it has been removed, but the means for tightening the cap consists of a metal band that must be placed about the cap before the latter is tightened on the neck. It is rather difficult to put the band in place around the cap.

An object of the invention is to provide a tool for closing bottles closed with crown caps. Another object of the invention is to provide a tool that facilitates the opening and reclosing of bottles, using the original crown cap.

In accordance with the invention, this object is attained by providing the tool handle with tightening means having an expansible split ring for surrounding the cap, the tool further including means associated with the handle and the split ring for causing the latter to contract in response to force applied to the handle so as to tighten the cap about the bottle neck when capping the bottle.

BRIEF DESCRIPTION OF THE DRAWINGS

With reference to FIGS. 1 to 4, the tool comprises an elongated handle 1 having two downwardly extending side walls 2 and 3, which support a pivot pin 4 for a head comprising a tightener 5. The latter has a springly split ring 6 having two feet 7 and 8, one on each side of the ring gap. These feet are mounted on the pin 4 free to pivot and slide thereon. The gap of the ring 6 is covered by a curved plate 9 rigid with a foot 9*a* pivotally mounted on the pin 4. The side walls 2 and 3 incorporate a respective lip 10 and 11. These two lips project towards each other and mutually define a slot 12. Each of the edges 13 and 14 of the slot 12 constitutes a cam face for processing the feet 7 and 8 towards each other, when the handle 1 is turned on the pin 4.

Figure 1:
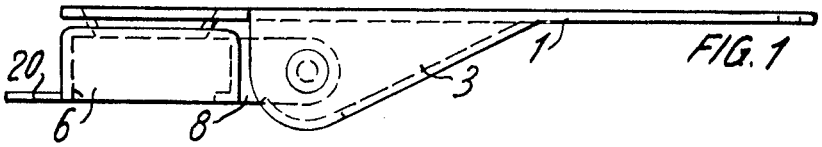
FIG. 1 is a side view of a first embodiment of the invention.
Figure 2:
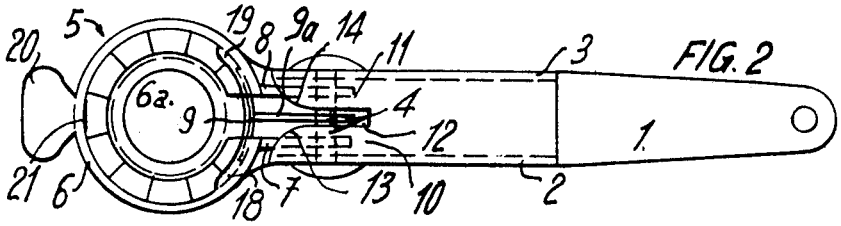
FIG. 2 is a bottom view of the embodiment shown in FIG. 1.
Figure 3:
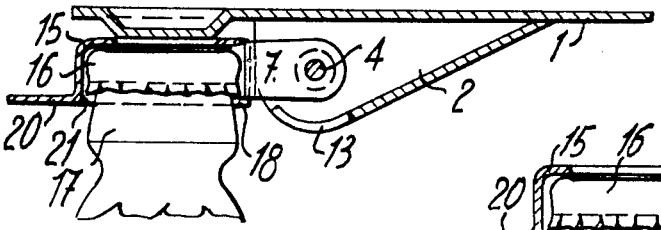
FIG. 3 is a side view, partly cut away, of the tool in working position on a crown capped bottle.

The split ring 6 also has an upper lip 15 that, as shown in FIG. 3, bears on the upper face of the cap, or lid, 16 sealing the mouth of the neck 17 of the bottle to be opened. The lip 15 consequently supports the entire tool on the cap. The split ring 6 also has, along its lower edge, a catch formed by two lips 18 and 19 for removing the cap of the closed bottle. The two lips 18 and 19 cover substantially one fourth of the periphery of the split ring 6.

Finally, the ring 6 incorporate a hand grip 20, which facilitates the manipulation of the tool.

FIG. 3 shows the tool placed on the cap of a bottle. The lips 18 and 19 extend underneath the cap 16, so that to remove the latter it is only necessary to raise the handle 1 with respect to the bottle. After the cap is removed, it is held in the split ring 6 by the lips 18 and 19 and by a projection 21. Consequently, the cap remains ready to reclose the bottle.

Figure 4:
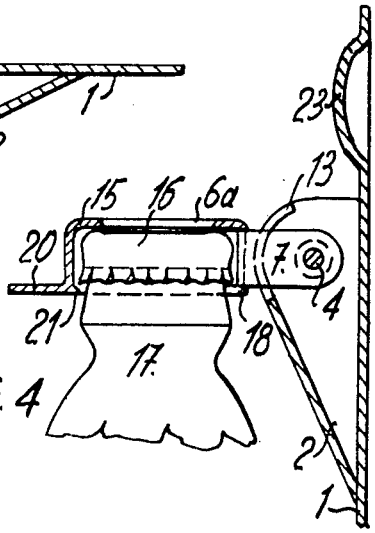
FIG. 4 is a side view, likewise partly cut away, showing the pivoted handle position for reclosing the bottle.

To do this, the tool with the cap 16 is again placed on the neck 17, and with a light axial pressure the cap 16 slides over the collar, or bead, of the neck. This done, it is only necessary to turn down the handle 1, as shown in FIG. 4, to cause the edges 13 and 14 of the slot 12 to push on the feet 7 and 8 of the split ring 6 and to press them towards each other. As a consequence, the split ring, which is expansible because of its own elasticity, is reduced to a smaller diameter. The radial contraction imposed on the ring 6 tightens the cap 16 on the neck 17 and compresses the seal, which is always incorporated in the interior of the cap, against the neck.

Inasmuch as the dimension for caps and bottle necks are standardized, it is possible to dimension the ring 6, the feet 7 and 8, and the slot 12 so as to obtain a maximum tightening of the cap on the neck, while avoiding the risk of breaking a glass bottle because of excessive pressure.

The split ring 6 has a central opening 6*a*, which enables the cap to be removed from the ring when the former is to be discarded, because, for example, the bottle being empty, there is no need to reclose it. The useless cap is more easily removed if the tightener 5 is first pivoted so as to squeeze the cap into a smaller diameter while it is still held in the ring 6.

The handle 1 also incorporates a depressed portion, or nose, 23 in the shape of a truncated cone. The dimensions of this portion are such that it can enter the central opening, in the positions shown in FIG. 3, and forcefully spread the split ring 6 to its maximum opening. The lower face of the portion 23 is slightly convex, so that when opening a bottle for the first time the portion 23 bears against the cap top and forms therein a depression that shows that the bottle has been opened, thereby preventing possible fraud.

Figure 5:
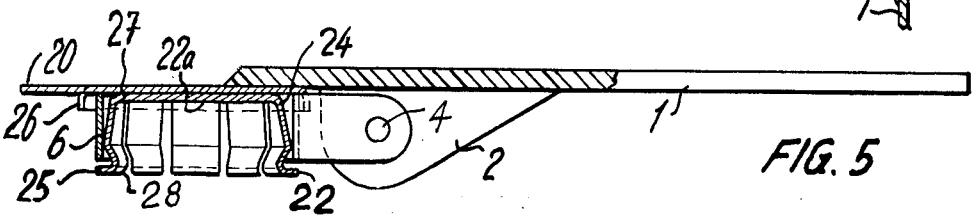
FIG. 5 is a side view, partly cut away, of a second embodiment of the invention.
Figure 6:
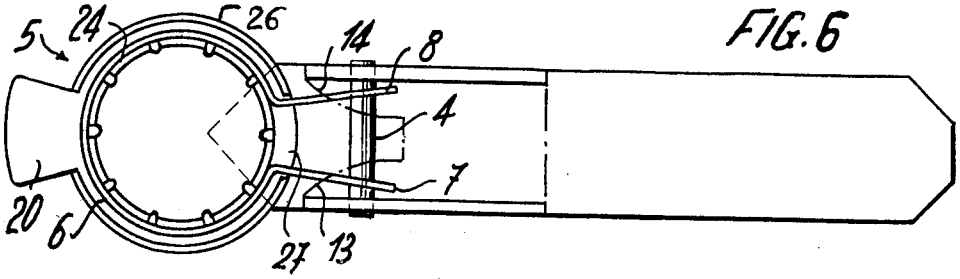
FIG. 6 is a bottom view of the embodiment shown in FIG. 5.

The second embodiment of the invention, shown in FIGS. 5 and 6, is particularly suitable for semi-professional use, because it enables new caps to be put in place and tightened the diameter of which is appreciably greater than that required simply for fitting over the neck bead.

In the second embodiment, the tightener further comprises a member 22 having the approximate shape of a tulip and held within the split ring 6. The tulip-shaped member has an upper support surface 22*a*, round in outer shape and continuing into a skirt 24 that is split substantially along its generatrices. The member 22 incorporates a lower lip 25 having a diameter larger than that of the split ring 6 and which extends underneath the latter. Moreover, the member 22 is rigid with respect to an upper lip 26, which has a diameter greater than that of the split ring 6 and which surrounds the latter at the top thereof. The upper lip 26 consists of the edge of a disc 27 that is rigidly held to the member 22 by any suitable means, such as spot welding, FIG. 5 also shows that a circular lip 28, extending inwardly, is provided between the outer lip 25 and the skirt 24 of the tulip-shaped member 22. The purpose of the lip 28 is to take hold of the cap underneath the lower edge of the latter and thereby enable, by pivoting the handle 1, removal of the cap from the bottle. The lip 28 is circular and has a diameter slightly smaller than that of the cap, the cap being resiliently held within the member 22 after the bottle is opened.

To replace the cap on the bottle, the cap is placed over the terminal bead of the bottle neck, and the handle 1 is pivoted, as with the first embodiment, causing the split ring 6 to tighten radially about the tulip-shaped member 22. The latter consequently tightly squeezes the cap on the neck, ensuring a hermetic sealing of the bottle.

The tulip-shaped member 22 is functionally advantageous, because it ensures that the tightening action is evenly distributed over the entire edge of the neck.

In accordance with the invention, numerous modifications are possible. For example, the tool can be furnished with two heads, one for each of the two standard cap dimension, each head comprising a tightener and, preferably, one or more lips for removing caps, as already described.

The cam faces 13 and 14 for squeezing the split ring 6 can be replaced by a cam face of a single edge of the slot 12. It is clear that, in accordance with the invention, still other arrangements are possible for contracting the expansible ring 6 by pivoting the handle 1 about an axis substantially parallel to the plane defined by this ring and perpendicular to the lengthwise direction of the handle.

Although the invention has been described and particularly shown with reference to the preferred embodiments, those skilled in the art will understand that the invention admits of changes in form and detail, aside from those already described, without exceeding the scope and spirit thereof.

I claim:

1. A tool for closing bottles with a crown cap, said tool including a handle, tightening means carried by said handle for tightening the crown cap on the neck of the bottle to close the latter, said tightening means comprising an expansible split ring for surrounding said cap, means associated with said handle and with said split ring for causing the latter to contract in response to a certain force applied to said handle so as to tighten the cap about the bottle neck, said split ring defining a plane and said handle defining a lengthwise direction, said means for causing said split ring to contract including pivot means for said handle to permit the latter to pivot about an axis substantially parallel to said plane of said split ring and perpendicular to said lengthwise direction of said handle, cam means associated with said handle for contracting said split ring when said certain force is applied to said handle to cause the latter to turn on said axis, said split ring including an upper lip, as seen in the normal working position of the tool, for supporting the tool on the upper face of the cap of the capped bottle , said split ring having an upper central opening, as seen in the normal working position of the tool, said handle including a nose for entering said central opening when said handle and said tightening means are in said non-tightening position and for causing a tell-tale depression in the upper face of the cap to show that the bottle was already opened.

2. The tool as defined in claim 1 comprising at least one peripheral lip provided on the periphery of said split ring, said peripheral lip extending circumferentially over at least a portion of said periphery, said lip being adapted to be engaged underneath the lower edge of a crown cap closing a bottle to remove said cap and open the bottle.

3. The tool as defined in claim 2, wherein said handle has two spaces side walls, said pivot means comprising an axle that is mounted in said side walls coaxial with said axis, said tightening means comprising two spaced feet rigidly associated with said split ring and located on respective sides of the gap in said split ring, said two feet being mounted on said axle free to pivot and to slide longitudinally thereon, whereby said tightening means and said handle are free to pivot, one with respect to the other, from a non-tightening position to a tightening position, about said axle, said cam means comprising at least one cam lip defining a cam face for engaging one of said feet and causing contraction of said split ring when said handle and said tightening means are in said tightening position.

4. The tool as defined in claim 3, wherein said cam means comprise two cam lips, each defining a cam face for engaging respective ones of said feet and causing contraction of said split ring.

5. The tool as defined in Claim 3, wherein said split ring includes a projection for engaging underneath the cap and holding the latter within said split ring when the cap has been removed from the bottle, catch means comprising peripheral lips on the lower edge of said split ring, said projection being located substantially diametrically opposite said peripheral lips of said catch means.

6. The tool as defined in claim 1, wherein the relative dimensions of said nose and said upper central opening are such that said nose when it enters the opening sufficiently acts on said split ring to expand it, thereby facilitating removal of the cap from the ring.

7. A tool for closing bottles with a crown cap, said tool including a handle, tightening means carried by said handle for tightening the crown cap on the neck of the bottle to close the latter, said tightening means comprising an expansible split ring for surrounding said cap, means associated with said handle and with said split ring for causing the latter to contract in response to a certain force applied to said handle so as to tighten the cap about the bottle neck, said split ring defining a plane and said handle defining a lengthwise direction, said means for causing said split ring to contract including pivot means for said handle to permit the latter to pivot about an axis substantially parallel to said plane of said split ring and perpendicular to said lengthwise direction of said handle, cam means associated with said handle for contracting said split ring when said certain force is applied to said handle to cuase the latter to turn on said axis, said split ring including an upper lip, as seen in the normal working position of the tool, for supporting the tool on the upper face of the cap of the capped bottle, and at least one lower lip on the lower edge of the periphery of said split ring, said at least one lower lip extending circumferentially over a portion of said periphery, said lower lip engaging underneath the lower edge of a crown cap closing a bottle to remove said cap and open the bottom

8. A tool for closing bottles with a crown cap, said tool including a handle, tightening means carried by said handle for tightening the crown cap on the neck of the bottle to close the latter, said tightening means comprising an expansible split ring for surrounding said cap, means associated with said handle and said split ring for causing the latter to contract in response to a certain force applied to said handle so as to tighten the cap about the bottle neck, said tightening means further comprising a tulip-shaped member for surrounding the cap and located within said split ring, said tulip-shaped member having an upper support surface, as seen in the normal working position of the tool, said support surface continuing into an annular split skirt having a plurality of splits for permitting contraction of the skirt from a rest position, said split ring, when contracted, pressing on said split skirt to contract the latter and to cause it to squeeze on the cap and to tighten the latter on the bottle neck.

9. The tool as defined in claim 8, wherein said splits of said skirt are located substantially along generatrices of the latter.

10. The tool as defined in claim 8, wherein said support surface is round in outer shape.

11. The tool as defined in claim 8, wherein said tulip-shaped member has a lower lip, as seen in the normal working position of the tool, that extends underneath said split ring and has a maximum diameter greater than the diameter of said split ring.

12. The tool as defined in claim 11, further including an upper lip, as seen in the normal working position of the tool, that surrounds said split ring, said upper lip being rigidly connected to said tulip-shaped member.

13. The tool as defined in claim 12, further including a disc rigid with said tulip-shaped member, the edge of said disc constituting said upper lip.

14. The tool as defined in claim 11, wherein said split ring defines a plane and said handle defines a lengthwise direction, and said means for causing said split ring to contract include pivot means for said handle for permitting the latter to pivot about an axis substantially parallel to said plane of said split ring and perpendicular to said lengthwise direction of said handle, and cam means associated with said handle for contracting said split ring when said a certain force is applied to said handle to cause the latter to turn on said axis.

15. The tool as defined in claim 14, wherein said handle has two spaced side walls, said pivot means comprising an axle that is mounted in said side walls coaxial with said axis, said tightening means comprising two spaced feet rigidly associated with said split ring and located on respective sides of the gap in said split ring, said two feet being mounted on said axle free to pivot and to slide longitudinally thereon, whereby said tightening means and said handle are free to pivot, one with respect to the other, from a non-tightening position to a tightening position, about said axle, said cam means comprising at least one cam lip defining a cam face for engaging one of said two feet and causing contraction of said split ring when said handle and said tightening means are in said tightening position.

16. The tool as defined in claim 15, wherein said cam means comprises two cam lips, each defining a cam face for engaging respective one of said two feet and causing contraction of said split ring.

* * * * *